US005897461A

United States Patent [19]

Socwell

[11] Patent Number: 5,897,461

[45] **Date of Patent: *Apr. 27, 1999**

[54] EXERCISE TREADMILL

[75] Inventor: Jeff D. Socwell, North Ogden, Utah

[73] Assignee: Precor Incorporated, Bothell, Wash.

[ * ] Notice: This patent is subject to a terminal disclaimer.

[21] Appl. No.: 09/009,582

[22] Filed: Jan. 20, 1998

Related U.S. Application Data

[63] Continuation-in-part of application No. 08/721,724, Sep. 27, 1996, Pat. No. 5,709,632.

[51] Int. Cl.[6] ..... A63B 22/02

[52] U.S. Cl. ..... 482/54

[58] Field of Search ..... 422/51, 54

[56] References Cited

U.S. PATENT DOCUMENTS

| | | | |
|---|---|---|---|
| 219,439 | 9/1879 | Blend . | |
| 1,211,765 | 1/1917 | Schmidt | 482/54 |
| 2,842,365 | 7/1958 | Kelley . | |
| 3,554,541 | 1/1971 | Seaman | 482/54 |
| 3,642,279 | 2/1972 | Cutter | 482/54 |
| 4,389,047 | 6/1983 | Hall | 482/54 |
| 4,616,822 | 10/1986 | Truslaske et al. | 482/54 |
| 4,938,473 | 7/1990 | Lee et al. | 482/54 |
| 5,100,127 | 3/1992 | Melnick et al. | 482/54 |
| 5,125,361 | 6/1992 | Rowlands | 482/54 |
| 5,135,458 | 8/1992 | Huang . | |
| 5,391,129 | 2/1995 | Zaitsev | 482/56 |
| 5,431,612 | 7/1995 | Holden | 482/54 |
| 5,575,740 | 11/1996 | Piaget et al. | 482/51 |
| 5,709,632 | 1/1998 | Socwell | 482/54 |

FOREIGN PATENT DOCUMENTS 0 144 294 6/1985 European Pat. Off. .

OTHER PUBLICATIONS

Document Information Copy of informational pamphlet entitled "Contour Jogger", by Battle Creek Equipment, Form CJ11, re Patent No. 3,642,279 (U10–above).

*Primary Examiner*—Lynne A. Reichard
*Attorney, Agent, or Firm*—Christensen O'Connor Johnson & Kindness PLLC

[57] ABSTRACT

A curved deck treadmill (10) is disclosed as comprising a support frame (12) having a first side (20) and a second opposing side (22) for supporting a deck (56) therebetween. The deck comprises a forward end (58), a near end (60), and an intermediate portion (62) disposed between the first and second ends. The intermediate portion of the deck is preferably formed in a substantially arcuate configuration such that a significant portion of the intermediate portion may be operably disposed dimensionally lower in longitudinal relation to the first and second ends of the deck. Further, a roller assembly (14) is provided preferably comprising a first roller (78) and second roller (86). The first roller may be rotatably disposed contiguous the first end of the deck between the first side and the second side of the support frame. Correspondingly, the second roller is preferably disposed contiguous the second end of the deck between the first and second sides of the support frame. In operation, an endless belt (16) may be rotatably mounted in relation to the roller assembly (14) and operatively disposed in relation to the deck (56), thereby providing a structurally supported arcuate shaped, movable surface on which a user may exercise.

38 Claims, 10 Drawing Sheets

EXERCISE TREADMILL

CROSS-REFERENCE TO RELATED APPLICATION

The present application is a continuation-in-part of application Ser. No. 08/721,724 filed on Sep. 27, 1996, now U.S. Pat. No. 5,709,632.

FIELD OF THE INVENTION

This invention relates to exercise treadmills and, more particularly, to novel systems and methods for providing a curved deck treadmill.

BACKGROUND OF THE INVENTION

In an effort to generally improve one's health, many people regularly exercise on treadmills by walking, jogging and/or running along a rotating surface. Although exercise treadmills have been found to be useful, the exercise treadmills of the prior art incorporate several inherent disadvantages.

Traditionally, prior art exercise treadmills may be constructed comprising an endless belt rotatably disposed in relation to a plurality of anti-friction rollers which are rigidly secured to a frame. A significant disadvantage of prior art exercise treadmills of this general type may include the uncomfortable vibrating sensation and/or bruising which is commonly realized by a user when attempting to exercise thereon. In addition, if sufficient frictional resistance is not found in relation to the rotation of the free-moving rollers rotatably engaging the belt, a user attempting to exercise on the treadmill may suffer from injuries sustained as a result of an uncontrolled rotation of the anti-friction rollers engaging the belt. In particular, if the rollers supportably disposed in relation to the endless belt are so easily movable, the user may potentially lose his equilibrium or balance and fall from the exercise treadmill resulting in possible injuries.

In an attempt to reduce the potential dangers associated with falling from prior art exercise treadmills comprising anti-frictional, free-moving rollers, those skilled in the art developed rollers providing frictional resistance in relation to the inherent rotation of the rollers and the belt. Prior art exercise treadmills having frictional resistance in relation to the rollers, however, are typically found to have a difficulty in maintaining a sufficient balance between too much resistance and not enough. If, for example, the rollers are incapable of storing sufficient kinetic energy to overcome the established frictional resistance, after the rollers of the treadmill begin to rotate, the belt supportably disposed in relation to the rollers generally will not have the tendency to continue in a rotational motion. In this regard, exercise treadmills of the prior art should generally balance these competing factors and provide a corresponding frictional resistance that accommodates a smooth, continuous movement of the belt, without encountering a series of stops or starts that may result in simultaneous jerking motions in the movement of the endless belt.

To address the foregoing problems associated with frictional resistant roller assemblies, those skilled in the art developed exercise treadmills having a motor disposed in relation to the rollers to provide a means for regulating a constant rotational speed of the rotating endless belt. As realized, prior art exercise treadmills incorporating a motor for driving the rotational speed of the rollers and belt commonly obviate the requirement to balance the resistance and stored kinetic energy customarily needed in prior art exercise treadmills embodying frictional resistance roller assemblies.

A meaningful disadvantage of prior art motorized exercise treadmills includes the general disposition or placement of the motor in relation to the roller assembly and belt. Accordingly, the motor may be generally disposed either in front of, behind, or at one side of the endless belt. The usual placement or disposition of the motor in relation to prior art exercise treadmills, however, typically minimizes valuable space which could be alternatively allocated to the disposition of other internally working components of the treadmill or for the purpose of increasing the walking surface provided by the dimensional size of the belt.

In accordance with prior art exercise treadmills comprising a flat, horizontal or slightly inclined movable surface, the endless belt supportably disposed in relation to the rollers will typically absorb the full impact force of the foot of a user repetitively depressed thereagainst. The impact force sustained by the endless belt of prior art exercise treadmills generally produces a breaking effect which causes temporary stalling of the rotational movement of the belt. This undesirable stalling motion of the belt typically alters the continuity of the user's exercise routine and may further institute jerking movements with each step of the user. As the force or pressure associated with the impact of the user's feet on the flat, horizontal surface increases, the more likely prior art exercise treadmills will realize this breaking effect. In this regard, a heavy person running on a horizontal belt supported by rollers engaging a frame will more likely introduce a consistent breaking effect on the rotational movement of the belt, than a lighter person walking on the same treadmill.

Similarly, exercise treadmills of the prior art were developed to provide a springy and resilient walking surface. Prior art exercise treadmills of this type and the flat surface treadmills of the prior art, however, commonly encourage a form of bobbing effect in relation to the up and down motion of the user's body in relation to the movable surface or belt of the treadmill. This continual bobbing up and down usually makes it nearly impossible for a user to reach and maintain a steady position on the surface of the belt of the treadmill. In addition, because the support structure disposed in relation to the rotating belt is formed to provide a springy and resilient walking surface, a user may feel as if he is wading on the treadmill, rather than walking, jogging or running. Consistent therewith, these types of prior art exercise treadmills are generally unable to satisfactorily simulate natural walking, jogging or running.

Another meaningful disadvantage of exercise treadmills of the prior art is the inherent danger associated with users tending to fall off the back end of the treadmill and become injured. Several attempts have been made to keep a user exercising on prior exercise treadmills from falling off the back end of the endless belt and from the treadmill frame. For example, prior art exercise treadmills were developed by those skilled in the art which include a belt for harnessing the user to the treadmill. Unfortunately, harnessing a user to the treadmill is often found to be as dangerous as falling off the back of the treadmill.

Additionally, exercise treadmills of the prior art may furnish a user with an upright handle to grasp while exercising. While somewhat useful in retaining the user's balance on the rotating endless belt, having to grasp a fixed handle may impede the natural body motion of a user attempting to exercise. Such an encumbrance may be feasible when a user is attempting to walk, but when a user begins to jog or run on prior art exercise treadmills, having to grasp a handle to keep centered on the treadmill may severely interfere with one's natural body motion and further abdicate the inherent physical advantages of the exercise routine.

Another meaningful disadvantage of prior art exercise treadmills is their general inability to reduce the physical impact to the joints and muscles of a user conducting general exercise routines in relation thereto. In this regard, an exercise treadmill which is capable of reducing the physical impact on the knees and back of a user will resolve several barriers left unsolved by known prior art devices, especially in light of providing an operative role in rehabilitative exercises.

Consistent with the foregoing and as illustrated by the number of prior art patents and other disclosures, efforts are continuously being made in an attempt to remedy the above-identified disadvantages. While prior art exercise treadmills may appear generally suitable for their intended purpose, they nevertheless leave much to be desired from the standpoint of effectiveness of operation, safety, reducing the physical impact to the joints and muscles of a user, and simulating the natural body motion of the user exercising thereon. In this regard, the present invention provides for a novel curved deck treadmill which overcomes several deficiencies of exercise treadmills of the prior art and resolves several problems left unsolved by the known prior art.

SUMMARY OF THE INVENTION

In view of the foregoing, it is a primary object of the present invention to provide a novel curved deck treadmill which provides a structurally supported arcuate shaped, movable surface on which a user may exercise.

It is also an object of the present invention to provide a curved deck treadmill which comprises a first end and a second end disposed substantially parallel in dimensional relationship and including a deck having an intermediate portion disposed therebetween comprising a substantially arcuate longitudinal configuration which is disposed lower in dimensional relation to the first and second ends.

Further, it is an object of the present invention to provide a curved deck treadmill which maximizes the upper surface area of the belt by effective disposition of a driving means.

It is a still further object of the present invention to provide a curved deck treadmill which substantially prevents a user from falling off the back end of the treadmill and whereby serving to keep the user centered on the upper surface of the treadmill without encumbering the natural body motion of the user exercising thereon.

In addition, it is an object of the present invention to provide a curved deck treadmill which is capable of providing meaningful walking, jogging, or running comfort in relation to the physiology of a user, thereby facilitating an upper surface which supportably provides for a longer stride with more flexibility.

Moreover, it is an object of the present invention to provide a curved deck treadmill which is capable of reducing the physical impact to the joints and muscles (e.g., the knees and back) of a user, thus providing an operative device having rehabilitative functionality.

Similarly, it is an object of the present invention to provide a curved deck treadmill which provides a continuous, smooth exercising motion.

Consistent with the foregoing objects, and in accordance with the invention as embodied and broadly described herein, a curved deck treadmill is disclosed in one embodiment of the present invention as including a support frame comprising a first side and a second opposing side having a deck supportably disposed therebetween. In preferred design, the deck comprises a first end, a second end, and an intermediate portion disposed between the first and second ends. The intermediate portion of the deck is preferably formed having a substantially arcuate configuration such that a significant portion of the intermediate portion may be operably disposed dimensionally lower in longitudinal relation to the first and second ends of the deck. Further, a roller assembly is provided preferably comprising a first and second roller. The first roller may be rotatably disposed contiguous the first end of the deck between the first side and the second side of the support frame. Correspondingly similar in construction and design, a second roller is preferably disposed contiguous the second end of the deck between the first and second sides of the support frame. In operation, an endless belt may be rotatably mounted in relation to the roller assembly and operatively disposed in relation to the deck, whereby providing a structurally supported arcuate shaped, movable surface on which a user may exercise.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the FIGURES herein, could be arranged and designed in a wide variety of different configurations. Thus, the following more detailed description of the embodiments of the system and method of the present invention, as represented in FIGS. 1 through 5, is not intended to limit the scope of the invention, as claimed, but it is merely representative of the presently preferred embodiments of the invention.

Figure 1:
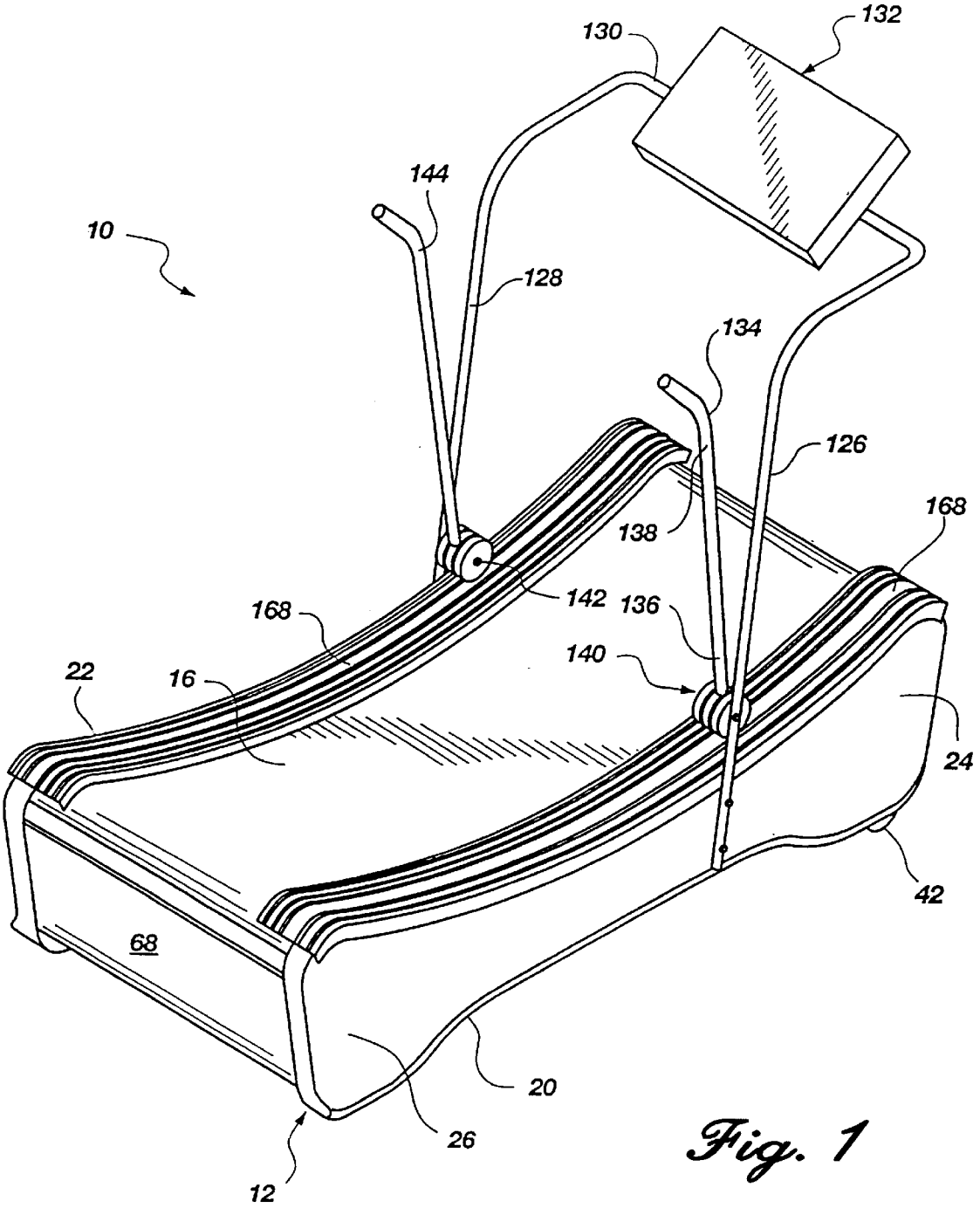
FIG. 1 is a perspective view of one presently preferred embodiment of a curved deck treadmill.
Figure 2:
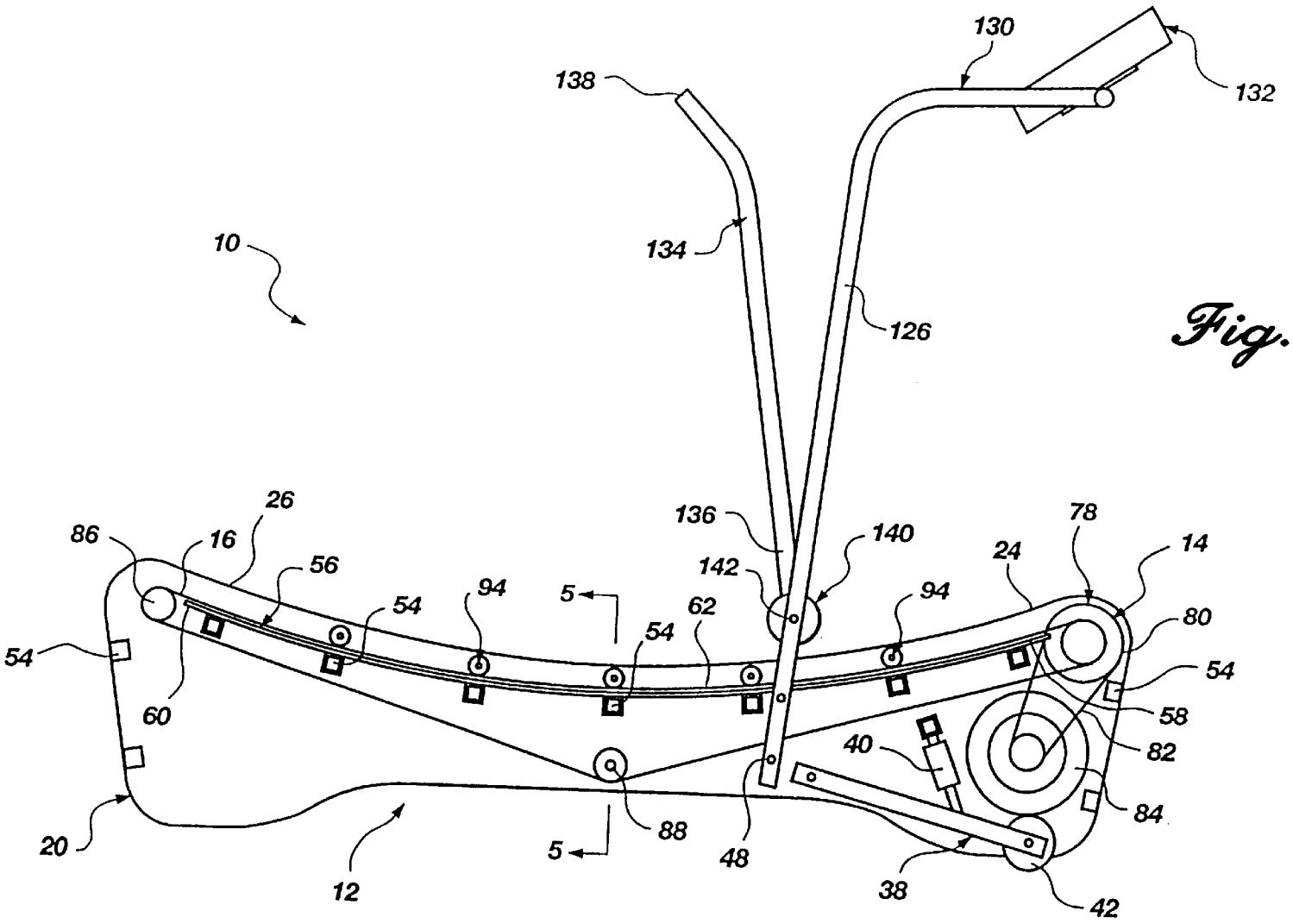
FIG. 2 is a side elevational view of the embodiment of FIG. 1 exposing one presently preferred arrangement of the internal components of the present invention.

The presently preferred embodiments of the invention will be best understood by reference to the drawings, wherein like parts are designated by like numerals throughout. One presently preferred embodiment of the present invention, designated generally at 10, is best illustrated in FIGS. 1 and 2. As shown, the curved deck treadmill 10 comprises a support frame 12 having a first side 20 and a second opposing side 22 and having a deck 56 supportably disposed therebetween. In preferred construction, the deck 56 comprises a first end 58, a second end 60, and an intermediate portion 62 disposed therebetween. The intermediate portion 62 of the deck 56 is preferably formed having an arcuate configuration such that a significant portion of the intermediate portion 62 may be operably disposed dimensionally lower in longitudinal relationship to the first and second ends 58, 60 of the deck 56. Further, a roller assembly 14 is provided preferably comprising a first and second roller 78, 86. The first roller 78 may be rotatably disposed contiguous the first end 58 of the deck 56 between the first side 20 and the second opposing side 22 of the support frame 12. Correspondingly similar in construction and design, a second roller 86 is preferably disposed contiguous the second end 60 of the deck 56 between the first and second sides 20, 22 of the support frame 12. In preferred operation, a belt 16 is rotatably mounted in relation to the roller assembly 14 and operatively disposed in relation to the deck 56, whereby providing a structurally supported arcuate shaped, movable surface on which a user may exercise.

As further illustrated in FIGS. 1 and 2, at least one crossbar 130 may be structurally supported in relation to the support frame 12. Preferably, the crossbar 130 functionally supports a console 132 substantially above the upper surface area of the support frame 12, deck 56, and belt 16. Disposed in relation to the support frame 12, the crossbar 130 may be formed having a generally U-shaped configuration. Further, the crossbar 130 may comprise a pivotal engagement 140 which provides a means for pivotally engaging one or more handles 134, 144 in relation to the crossbar 130 at the opposing sides thereof 126, 128.

Structurally, the support frame 12 preferably comprises a first side 20 and a second opposing side 22 which, in combination, provide a means for structurally supporting the curved deck treadmill 10 and the various components thereof. In one preferred embodiment of the present invention, the support frame 12 is preferably formed of a substantially sturdy, rigid material which provides sufficient structural integrity to support the curved deck treadmill 10 and a user exercising thereon. For example, the support frame 12 may be formed of any of numerous organic, synthetic or processed materials which are mostly thermoplastic or thermosetting polymers of high molecular weight with or without additives, such as, plasticizers, auto oxidants, extenders, colorants, ultraviolet light stabilizers, or fillers, which can be shaped, molded, cast, extruded, drawn, foamed or laminated. It will be readily appreciated by those skilled in the art, however, that a wide variety of other suitable materials such as, metal or metal alloys, fiberglass, wood, ceramic, graphite and/or other composite or polymeric materials are possible which are consistent with the spirit and scope of the present invention.

Preferably, the support frame 12 may be formed having a first side 20 being disposed substantially parallel a second opposing side 22, whereby providing a generally longitudinal alignment therebetween. In one presently preferred embodiment of the present invention, because the first side 20 and the second side 22 of the support frame 12 are relatively constructed having a substantially comparable structure and configuration, only the first side 20 will be operatively disclosed in detail herein. Whereas, any structural variation(s) which exist between the first side 20 and the second opposing side 22 will be further disclosed, whereby noting such variation(s).

Figure 3:
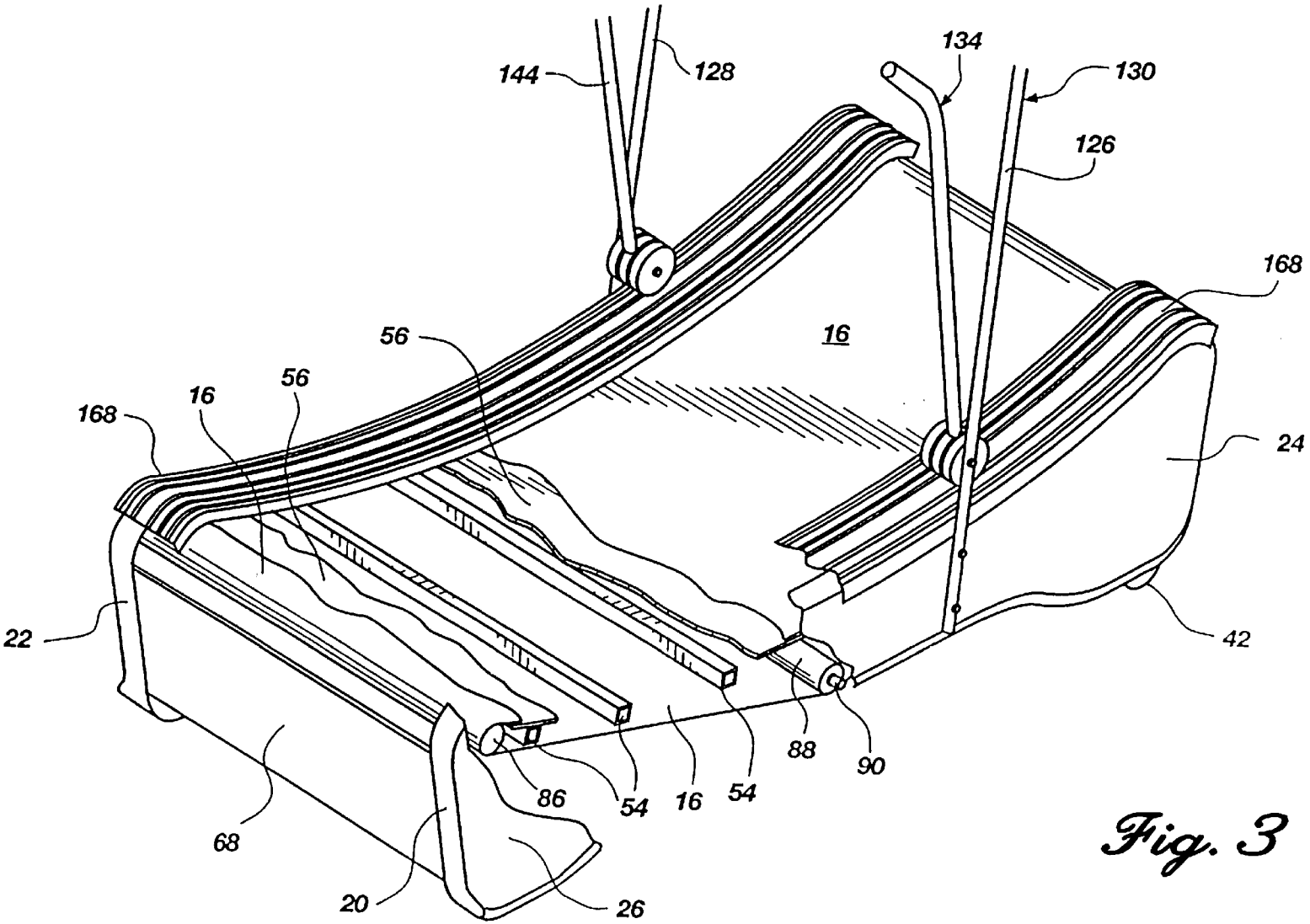
FIG. 3 is a cut-away view of the embodiment of FIG. 1.
Figure 4:
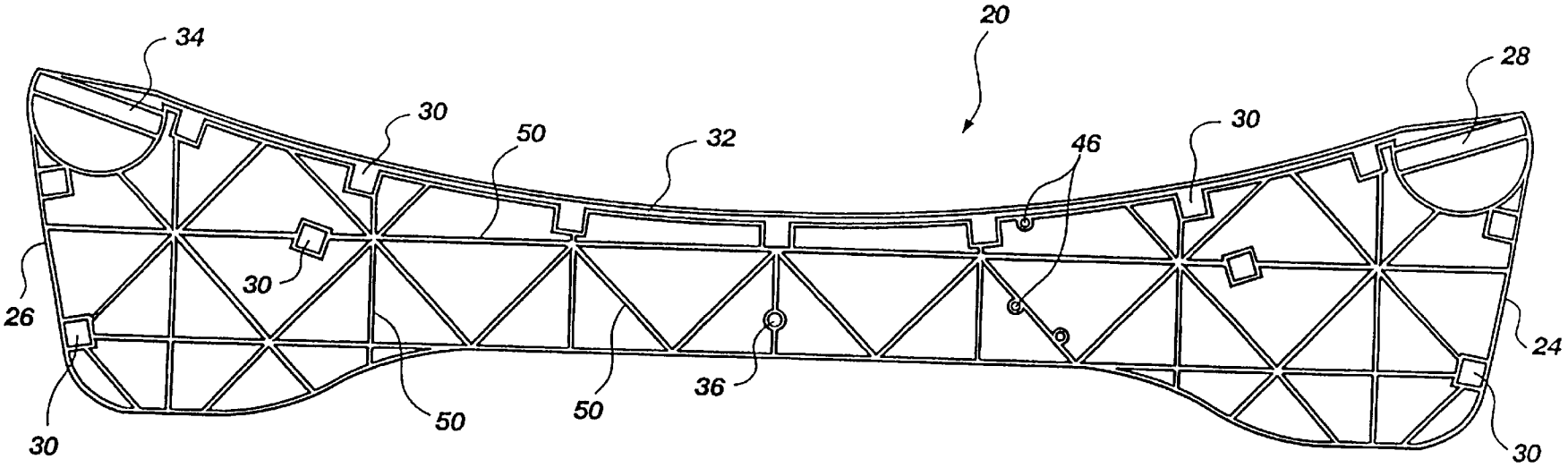
FIG. 4 is a side elevational view of one presently preferred embodiment of one side of a support frame of one presently preferred embodiment of the present invention.

As shown in FIGS. 1 and 3, the first side 20 of the support frame 12 includes a first end 24 and a second opposing end 26. The first and second ends 24, 26 of the first side 20 are preferably disposed in corresponding relation to the first and second ends 58, 60 of the deck 56. As best illustrated in FIGS. 2 and 4, a first journal housing 28 may be formed substantially adjacent the first end 24 of the first side 20 of the support frame 12. Preferably, the first journal housing 28 is formed having an opening readily adapted to receive at least one journaling end (not shown) of the first roller 78. Similarly, a second journal housing 34 may be formed substantially adjacent the second end 26 of the first side 20 of the support frame 12 and include an opening readily adapted to receive at least one journaling end (not shown) of the second roller 86.

In preferred design, the journal housings 28, 34 formed at the first and second ends 24, 26 of the first side 20 of the support frame 12, respectively, may be formed having an opening which provides a means for facilitating the introduction of the journaling ends of the respective first and second rollers 78, 86. Preferably, the opening comprises an elongated slot wherein the journaling ends of the first and second rollers 78, 86 may be slidably adjusted. By introducing the journaling ends of the first and second rollers 78, 86 in the respective elongated slots formed in the journal housings 28, 34 of the support frame 12, the horizontal displacement of the belt 16 may, accordingly, be adjusted in relation to the disposition of the first and second rollers 78, 86.

Figure 5:
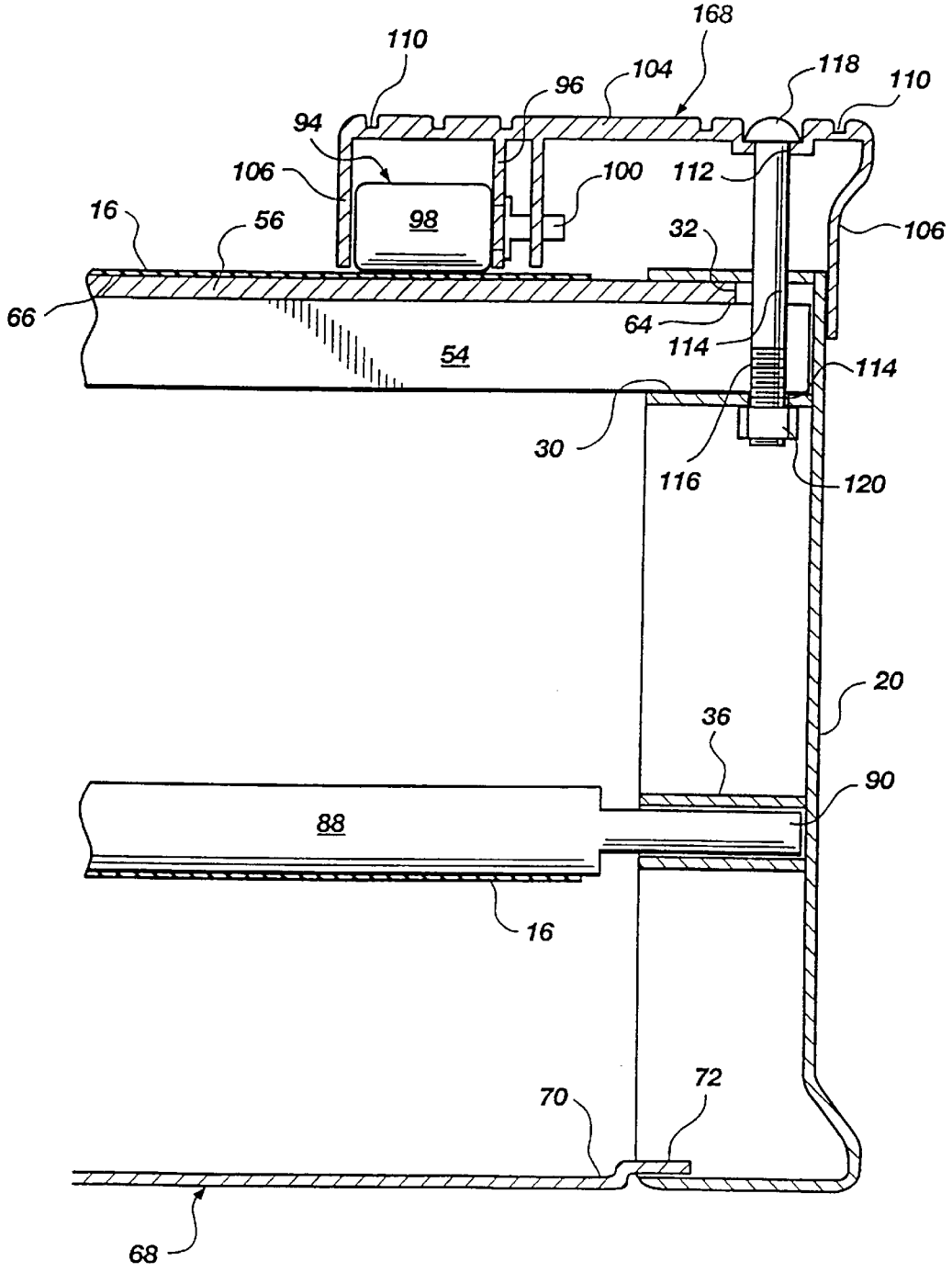
FIG. 5 is an exploded, fragmentary cross-sectional view of the embodiment of FIG. 2 taken along lines 5—5 of FIG. 2.

In one presently preferred embodiment of the present invention, a third journal housing 36 may be formed in the first side 20 of the support frame 12, as best illustrated in FIGS. 2, 4 and 5. Preferably formed between the first journal housing 28 and the second journal housing 34 of the first side 20 of the support frame 12, the third journal housing 36 may be disposed dimensionally lower than the substantially horizontal displacement of the first and second journal housings 28, 34. Consistent with the first and second journal housings 28, 34, the third journal housing 36 is preferably formed including an opening having an internal periphery sufficient for introducing at least one journaling end 90 of the third roller 88 therein, as shown in FIG. 5. Preferably, the journaling end 90 of the third roller 88 is formed having a substantially cylindrical configuration comprising an outer diameter which is less than the internal diameter of the opening formed in the third journal housing 36. It will be readily appreciated by those skilled in the art, however, that other shapes, sizes and/or configurations of the journal housings 28, 34, 36 and/or the internal openings formed therein are possible as such to provide a means for introducing at least one journaling end of the first, second and third rollers 78, 86, 88, respectively, therein.

In accordance with one presently preferred embodiment of the present invention, the journal housings 28, 34, 36 formed in the first side 20 of the support frame 12 may be disposed in operative alignment with the journal housings formed in the second side 22 of the support frame 12. This arrangement of the journal housings 28, 34, 36 in both the first and second sides 20, 22 of the support frame 12 preferably provides for the introduction and retention of the journaling ends of the corresponding rollers 78, 86, 88, thereby facilitating a means for rotating the rollers on a substantially fixed axis.

Although the journal housings 28, 34, 36 of the first and second sides 20, 22 of the support frame 12 preferably receive the journaling ends of the respective rollers 78, 86, 88, it will be apparent to those skilled in the art that other mechanisms may be constructed and/or numerous other relative dispositions of the respective rollers may be anticipated in accordance with the inventive principles disclosed herein in order to achieve the desired results of the present invention. It is intended, therefore, that the examples provided herein be viewed as exemplary of the principles of the present invention, and not as restrictive to a particular structure or structures for implementing those principles.

Referring back to FIGS. 1 and 2, the belt 16 operably disposed in relation to the rollers 78, 86, 88 may be formed comprising an endless construction which preferably consists of a sufficiently sturdy material. For example, the belt 16 may be formed of an endless sheet of a flexible canvas or a rubber-impregnated material. The belt 16 may alternatively be formed of a thin, flat band of steel or a sufficiently tenacious polymeric or composite material. As will be readily appreciated by those skilled in the art, the belt 16 can, of course, be formed of a wide variety of suitable materials which are consistent with the spirit and scope of the present invention.

In accordance with one preferred arrangement, the belt 16 is rotatably disposed in relation to the first roller 78, the second roller 86, and the third roller 88, whereby each roller 78, 86, 88 is preferably disposed in structural relation to the support frame 12 at their respectively preferred positions, as disclosed above. The tension of the belt 16 may be readily tightened or loosened in relation to the disposition of the first and second rollers 78, 86 engagably disposed in the respective elongated slot of the journal housings 28, 34. Moreover, a conventional fixation member (not shown) may be utilized to provide a means for disposing the journaling ends of the rollers 78, 86, 88 in a fixed and/or adjustable relationship to the respective opening or elongated slot formed in the journal housings 28, 34, 36 of the support frame 12.

Referring back to the features of the support frame 12, a deck slot 32 may be formed which extends substantially the longitudinal length of the first side 20, as shown in FIG. 4. Preferably, the deck slot 32 is disposed such that the deck 56 may be insertably disposed therein. In one presently preferred embodiment of the present invention, the deck slot 32 comprises a substantially curvilinear configuration which substantially corresponds in dimensional shape to the arcuate configuration of the intermediate portion 62 of the deck 56. Similarly, the deck slot 32 is preferably formed having a sufficient size and depth sufficient to retain at least one longitudinal side of the deck 56 engagably inserted therein, such that any possible flexing of the deck 56 from the weight of a user will not generally unseat the deck 56 from the deck slot 32. Whereas, the opposing longitudinal side of the deck 56 is preferably disposed within the deck slot 32 formed in the second side 22 of the support frame 12.

In preferred construction, the deck 56 is formed of a substantially sturdy, rigid material to provide sufficient structural integrity to adequately support the weight of a user exercising on the curved deck treadmill 10. In one presently preferred embodiment of the present invention, the deck 56 is preferably formed consisting of a wood laminate having an upper surface 66 that may be impregnated with a wax material to provide a means for reducing the coefficient of friction acting thereon. In an alternate embodiment, the deck 56 may be formed of any of numerous organic, synthetic or processed materials which are mostly thermoplastic or thermosetting polymers of high molecular weight with or without additives, such as, plasticizers, auto oxidants, extenders, colorants, ultraviolet light stabilizers, or fillers, which can be shaped, molded, cast, extruded, drawn, foamed or laminated. It will be readily appreciated by those skilled in the art, however, that a wide variety of other suitable materials such as, metal or metal alloys, fiberglass, ceramic, graphite and/or other composite or polymeric materials are possible which are consistent with the spirit and scope of the present invention.

As shown in FIG. 4, the first side 20 of the support frame 12 may comprise one or more rib seats 30 disposed adjacent the deck slot 32. The rib seats 30 are preferably formed having an internal surface area sufficient for seating at least one end of a support rib 54 disposed therein. As best illustrated in FIG. 3, one or more support ribs 54 extend substantially transverse dimensionally between the first and second sides 20, 22 of the support frame 12. In preferred construction, the support ribs 54 provide a means for structurally supporting the deck 56. Similarly, the rib seats 30 are preferably formed such that when the support ribs 54 are introduced therein, the deck 56 may be readily disposed within the respective deck slots 32 formed in the first and second sides 20, 22 of the support frame 12 and structurally supported by the support ribs 54 disposed in relation thereto.

In one presently preferred embodiment of the present invention, the support ribs 54 are formed of a sufficiently sturdy, rigid material sufficient to provide adequate structural support to the deck 56. For example, the support ribs 54 may be formed of a rigid metal or metal alloy. It will be readily appreciated by those skilled in the art, however, that a wide variety of other suitable materials such as, fiberglass, ceramic, graphite, any of numerous organic, synthetic or processed materials which are mostly thermoplastic or thermosetting polymers of high molecular weight with or without additives, such as, plasticizers, auto oxidants, extenders, colorants, ultraviolet light stabilizers, or fillers, which can be shaped, molded, cast, extruded, drawn, foamed or laminated, and/or other composite materials are possible that are consistent with the spirit and scope of the present invention.

In current design, the support ribs 54 are formed having a generally elongated configuration which is capable of being seated in a corresponding rib seat 30 disposed in a spaced-apart relation in the first side 20 and the second opposing side 22 of the support frame 12. Accordingly, the rib seats 30 have a corresponding dimensional shape which provides a means for introducing and retaining the ends of the support ribs 54 therein.

As will be readily appreciated, the quantity and disposition of rib seats 30 and engaging support ribs 54 supportably disposed in relation to the support frame 12 may vary according to the structural integrity generally required to support the deck 56 and the weight of a user. For example, the addition of rib seats 30 and support ribs 54 near the first and second ends 24, 26 of the support frame 12 may increase the overall structural integrity of the deck 56 in relation to the support frame 12. Accordingly, those skilled in the art will readily recognize other possible modifications and adaptations which are consistent with the spirit and scope of the present invention.

In addition to the support ribs 54 which provide a means for engagably supporting the first and second sides 20, 22 of the support frame 12, the support frame 12 may include a plurality of structural reinforcement members 50 disposed in relation to the first and second sides 20, 22, as best shown in FIG. 4. As illustrated, the plurality of reinforcement members 50 may be disposed horizontally, vertically, and/or diagonally throughout the sides 20, 22 to provide a means for increasing the ability of the first and second sides 20, 22 to resist buckling or a loss of structural integrity. In one presently preferred embodiment of the present invention, the structural members 50 are preferably formed along the interior surface of the first side 20 of the support frame 12. It will be readily appreciated by those skilled in the art, however, that other structural reinforcing components may be added to further enhance the supportable nature of the support frame 12 or for enhancing the inherent aesthetics of the device.

In one presently preferred embodiment of the present invention, the first side 20 of the support frame 12 may comprise at least one conventional foot roller assembly 38 mountably disposed in relation thereto, as best shown in FIG. 2. The foot roller assembly 38 preferably includes one or more wheels 42 rotatably connected thereto in such a manner so as to provide a means for readily moving the curved deck treadmill 10. The foot roller assembly 38 may further comprise a force absorbing member 40 disposed in relation thereto which provides a means for absorbing any forces or shocks sustained while moving the present invention from one location to another. Correspondingly, the force absorbing member 40 may consist of a conventional shock absorber which is useful over rough surfaces in absorbing sudden movement, bounces, etc.

The force absorbing member 40 may also include a means for stabilizing the curved deck treadmill 10 at an elevated position so as to provide a means for inclining the front end 24 of the support frame 12 for increasing user workout. In this regard, the force absorbing member 40 may comprise a gas or oil filled shock or, in the alternative, an electric gear motor having a locking shaft which elevates the front end 24 of the support frame 12. It will be apparent that other mechanisms may be constructed in accordance with the inventive principles set forth herein. It is intended, therefore, that the example provided herein be viewed as exemplary of the principles of the present invention, and not as restrictive to a particular structure for implementing those principles.

As mentioned above, the second opposing side 22 of the support frame 12 is correspondingly similar in dimensional structure and configuration to that of the first side 20. Accordingly, the components disposed on or in relation to the first side 20 of the support frame 12 are preferably disposed on or in relation to the second side 22. The incorporation of substantially comparable sides 20, 22 of the support frame 12 comprises one presently preferred embodiment. It is intended, therefore, that the example provided herein be viewed as exemplary of the principles of the present invention, and not as restrictive to a particular structure for implementing those principles. Accordingly, the utilization of a support frame having correspondingly similar sides is thus by way of illustration only and not by way of limitation.

Referring now to FIG. 5, the curved deck treadmill 10 may include one or more belt securing assemblies 94 which provide a means for retaining the endless belt 16 in a curvilinear configuration being substantially flush with the upper surface 66 of the deck 56. Preferably, the belt securing assemblies 94 provide a means for substantially conforming the inherent flexible nature of the belt 16 to the arcuate configuration of the intermediate portion 62 of the deck 56. In design, one or more belt securing assemblies 94 may be disposed in spaced-apart relation along the upper surface 66 of the intermediate portion 62 of the deck 56, as shown in FIG. 2, to sufficiently retain the belt 16 in operable disposition to the deck 56.

In one presently preferred embodiment of the present invention, the belt securing assembly 94 comprises a roller 98 having an axle 100 which rotatably engages a mounting bracket 96. The mounting bracket 96 is preferably disposed in relation to the roller 98 such that the roller 98 may engage the belt 16, thereby substantially retaining a side portion of the belt 16 substantially flush with the deck 56. In preferred operation, as the belt 16 rotates in relation to the roller assembly 14, the rollers 98 of the belt securing assembly 94 preferably rotate in relation thereto. It will be apparent that other belt securing mechanisms may be constructed in accordance with the inventive principles set forth herein. Correspondingly, those skilled in the art may recognize other possible modifications and/or adaptations which are consistent with the spirit and scope of the present invention.

Referring back to FIGS. 1 and 3, a cover member 68 may be disposed in connection between the first and second sides 20, 22 of the support frame 12. The cover member 68 is preferably formed providing a means for covering the internal components of the curved deck treadmill 10. In current design, the cover member 68 may be removably disposed in connection to the first and second sides 20, 22 of the support frame 12 whereby allowing for easy access to the internal working components of the present invention. For example, the cover member 68 may be attached to the support frame 12 by a series of tabs 72 disposed along the outer edge 70 of the cover member 68 and arranged in such a manner so as to removably engage the first and second sides 20, 22, as illustrated depicted in FIG. 5. Additionally, a cover member 168 may provide a means for covering the belt securing assemblies 94 disposed in relation to the first and second sides 20, 22 of the support frame 12.

In preferred structure, the cover member 168 which is disposed in relation to covering the belt securing assembly 94 may comprise a horizontal portion 104 disposed in relation to one or more vertical sides 106. As discussed above, the mounting bracket 96 may be fixed to the cover member 168 such that it provides a means for assisting in the rotational alignment of the roller 98 of the belt securing assembly 94. Preferably, at least one vertical side 106 is disposed adjacent the roller 98 of the belt securing assembly 94 such that the vertical side 106 and the horizontal portion 104 of the cover member 168 substantially cover the belt securing assembly 94. Further, one or more longitudinal grooves 110 may be formed in the exterior surface of the horizontal portion 104 of the cover member 168, as best shown in FIGS. 1, 3 and 5. As will be readily appreciated, the cover member 168 may include other structural components for either functional or aesthetic reasons.

In one presently preferred embodiment of the present invention, the cover members 68, 168 are preferably formed of a substantially sturdy, semi-flexible material. For example, the cover members 68, 168 may be formed of any of numerous organic, synthetic or processed materials which are mostly thermoplastic or thermosetting polymers of high molecular weight with or without additives, such as, plasticizers, auto oxidants, extenders, colorants, ultraviolet light stabilizers, or fillers, which can be shaped, molded, cast, extruded, drawn, foamed or laminated. It will be readily appreciated by those skilled in the art, however, that a wide variety of other suitable materials such as, metal or metal alloys, fiberglass, wood, ceramic, graphite and/or other composite or polymeric materials are possible which are consistent with the spirit and scope of the present invention.

Referring now to FIG. 5, the belt securing assembly 94 and the corresponding cover member 68 may be attached to the support frame 12 by a conventional fastening means. For example, in one presently preferred embodiment of the present invention, a bolt 118 may be disposed through an aperture 112 formed in the cover member 168 and at least one aperture 114 formed in a respective side 20, 22 of the support frame 12. Alternatively, the bolt 118 may be disposed through an aperture 116 formed in a support rib 54 which may further serve to secure the support rib 54 to the support frame 12. Moreover, if a longitudinal side 64 of the deck 56 were to extend past the apertures formed in the cover member 168 and the support frame 12, a corresponding through-bore (not shown) may be formed in the deck 56 and disposed in alignment with the other apertures. If desired, a locking nut 120 may be disposed in relation to a first end of the bolt 118 to secure the preferred engagement outlined above between the various components of the curved deck treadmill 10.

In one presently preferred embodiment of the present invention, a driving means 84 is operably connected to at least one roller to enable the rotation of the belt 16. The driving means 84 preferably comprises a conventional electric motor for rotating the belt 16. In preferred arrangement, a pulley 80 is disposably mounted to the first roller 78 at the first end 24 of the support frame 12. In operation, a pulley belt 82 may be engagably disposed between the pulley 80 and the motor 84 to provide a means for correspondingly rotating the first roller 78 upon the forced rotation of the pulley belt 82 by the motor 84.

As best illustrated in FIG. 2, the motor 84 may be mounted to the support frame 12 substantially adjacent the first end 58 and beneath the deck 56 by means of a fixation bracket (not shown). Alternatively, it will be readily appreciated by those skilled in the art, however, that the motor 84 may be engagably disposed in relation to the second or third rollers 86, 88 to enable the rotation of the belt 16.

In an alternate embodiment, the curved deck treadmill 10 or the present invention may be implemented without a driving means engagably disposed to a roller in order to facilitate the forced rotation of the belt 16. If so implemented, the rollers 78, 86 and 88 and the deck 56 should be generally calibrated in relation to the belt 16 to provide an optimal frictional resistance to enable a user to safely walk, jog, and/or run thereon, while still providing sufficient resistance to enable a user to exercise.

Referring now to FIGS. 1, 2 and 3, a crossbar 130 may be preferably formed having a generally U-shaped configuration and may be disposed in fixed relation to the first and second sides 20, 22 of the support frame 12 by means of conventional fasteners. The fasteners may comprise one or more internally threaded seats 46 (as best shown in FIG. 4) wherein an appropriately sized fastener 48 may be introduced to provide a threaded or force-fit engagement therebetween for securing the first side 126 of the cross-bar 130 to the first side 20 of the support frame 12. A second end 128 of the crossbar 130 may be similarly mounted in a preferably fixed engagement to the second side 22 of the support frame 12. Although the crossbar 130 of the present invention is illustrated and described in connection with a generally U-shaped configuration, those skilled in the art will recognize that various other geometrical configurations are likewise suitable. The use of a generally U-shaped configuration is thus by way of illustration only and not by way of limitation.

In one presently preferred embodiment of the present invention, a console 132 is preferably mounted in relation to the cross-bar 130. Supportably disposed by the cross-bar 130, the console 132 may be mounted substantially above the support frame 12, the deck 56, and the belt 16 such that a user may view the information displayed on the console 132. The console 132 preferably comprises a processor, a display, and may include input keys for entering user programmable options. Similarly, the console 132 may provide a variety of feedback data, such as elapsed time, speed, distance, pulse rate, and/or other functions and features, as desired.

It will be appreciated by those skilled in the art that the console 132 may incorporate additional external components and/or devices in carrying out its function. For example, the console 132 may include one or more sensors for ascertaining the rotational speed of the belt 16, a sensor for determining the pulse or heart rate of a user, a device for controlling the speed of the motor, etc. Although such external components and/or devices are not specifically shown in the FIGURES, it is clearly contemplated by the present invention that such electronic and/or mechanical equipment are readily anticipated herein for utilization with the present invention.

In preferred structure, the crossbar 130 may comprise a pivotal engagement 140 which provides a means for pivotally engaging one or more handles 134, 144 in relation to the opposing sides 126, 128 of the crossbar 130, as illustrated in FIGS. 1, 2 and 3. The handles 134, 144 may be constructed of any suitable rigid material. For example, the handles 134, 144 may be formed of a metal or metal alloy, wood, fiberglass, graphite, ceramic, plastic or any other suitable composite material. Additionally, the handles 134, 144 may include a gripping member (not shown) preferably disposed substantially adjacent the distal ends of the handles 134, 144 to enable a user to more easily grip the handle. In particular, a rubber grip may be disposed in relation to the distal end 138 of the handle 134, 144 and positioned so that a user may grasp the gripping member of the handle 134, 144 when exercising.

Preferably, a first handle 134 includes a pivot end 136, a distal end 138 and an intermediate portion disposed therebetween. As best shown in FIG. 1, the pivot end 136 of the first handle 134 may be pivotally connected to the first side 126 of the crossbar 130 by means of a pivotal connection 140. In current design, the pivotal connection 140 comprises a conventional through-bore and a pivot pin 142 operably disposed therein, whereby providing a pivoting means for the handle 134 to pivot in relation thereto. Similarly, a second handle 144 may be pivotally connected to the second side 128 of the crossbar 130.

In functional operation, the handles 134 and 144 are preferably positioned such that a user may grasp approximate the distal end 138 of the handles 134, 144 while exercising and, accordingly, pivot the handles back and forth in correspondence to the user's stride, whereby potentially invoking an aerobic workout. In an alternative embodiment, the handles 134, 144 may be provided with some conventional form of resistance to further facilitate the exercising of the upper body of a user.

Although the first 134 and second handles 144 are described herein as being connected to the opposing sides 126, 128 of the crossbar 130 by a pivotal connection 140, it will be readily appreciated by those skilled in the art that other points of connection are possible. For example, the first and second handles 134, 144 may be pivotally connected to the first and second sides 20, 22, respectively, of the support frame 12. Alternatively, the handles 134, 144 may be operably connected to the motor 84 to provide a means for encouraging a user to maintain a predetermined, constant stride on the rotating belt 16, while maintaining a constant back-and-forth arm movement.

From the above discussion, it will be appreciated that the present invention provides a novel curved deck treadmill which provides a structurally supported arcuate shaped movable surface on which a user may exercise. The present invention further provides a curved deck treadmill which maximizes the upper surface area of the belt by effective disposition of the driving means. In addition, the present invention substantially prevents a user from falling off the back of the treadmill and whereby serves to keep the user centered on the upper surface of the rotating belt without encumbering the natural body motion of the user exercising thereon.

Unlike the prior art, the curved deck treadmill of the present invention comprises a first end and a second end disposed substantially parallel in dimensional relationship and including a deck having an intermediate portion disposed therebetween comprising a substantially arcuate longitudinal configuration which is disposed lower in dimensional relation to the first and second ends. Similarly, the novel configuration of the present invention is capable of reducing the physical impact to the joints and muscles (e.g., the knees and back) of a user, thus providing an operative device having rehabilitative functionality. Moreover, the present invention provides a continuous, smooth exercising motion capable of providing meaningful exercise comfort, thereby facilitating an upper surface which supportably provides for a longer stride with more flexibility. These objectives may be achieved by forming the deck with a curvature corresponding to a radius of about 3 to 20 feet and ideally about 4 to 10 feet. With a radius of this range, in a deck of a length of 4 feet, the intermediate portion of the deck would be about 0.75 to 0.1 feet below the first and second ends of the deck.

Figure 6:
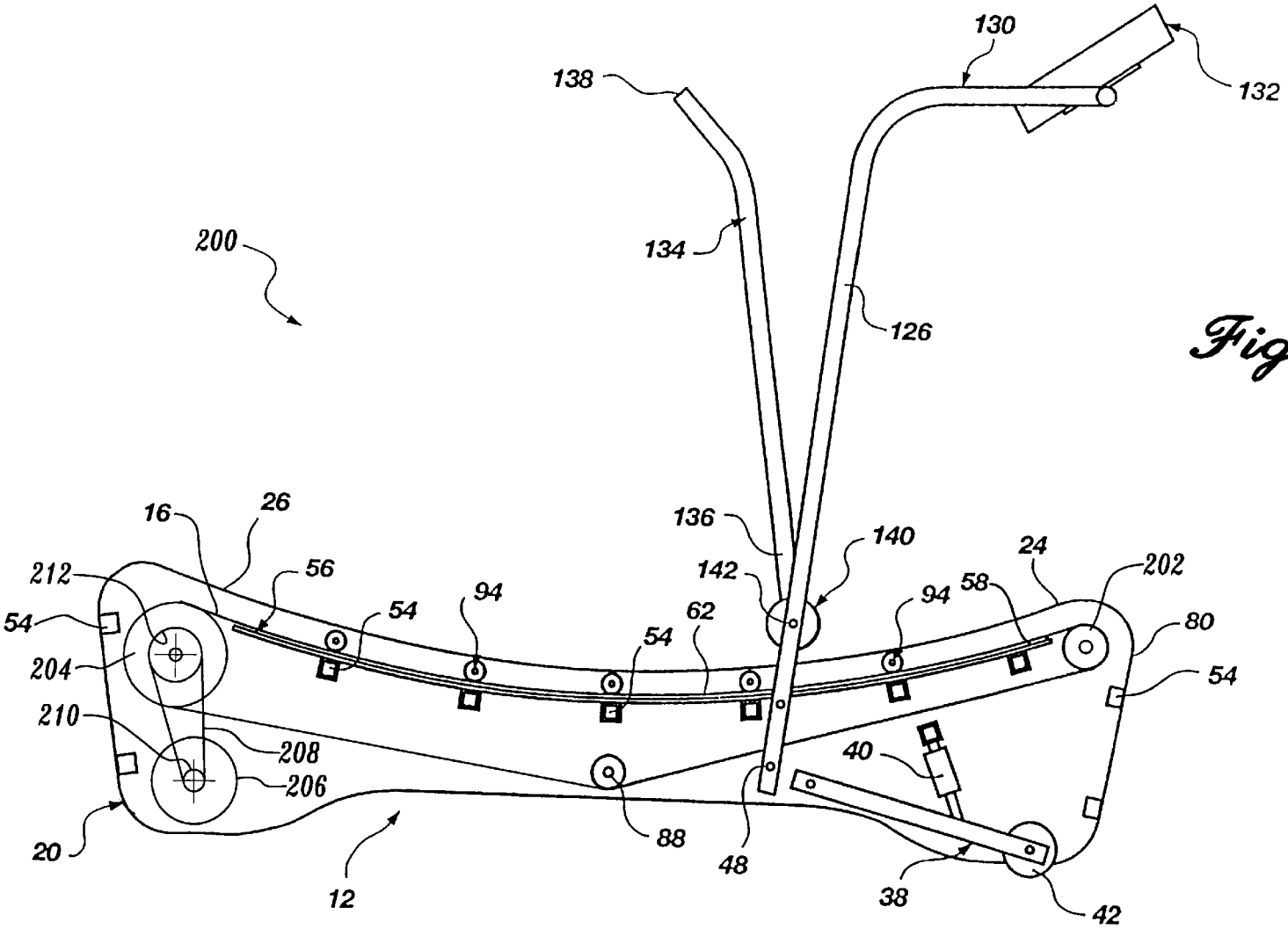
FIG. 6 is a side elevational view similar to FIG. 2 illustrating another preferred embodiment of the present invention.

FIG. 6 illustrates another preferred embodiment of the present invention wherein those components that are the same as or similar to those employed in the embodiment of the present invention shown in FIGS. 1–5 are designated with the same part numbers. In the embodiment of the present invention shown in FIG. 6, the endless belt 16 is driven at the rear of treadmill 200 rather than at the front. An idler roller 202 is rotatably mounted at the first or front end 58 of the deck 56 in a manner similar to the mounting of rear roller 86 shown in FIGS. 2 and 3. As such, the front end portion of belt 16 is trained about front idler roller 202.

A relatively large diameter drive drum 204 is rotatably mounted adjacent the second end 60 of deck 56 between the first and second opposing sides 20 and 22 of the support frame 12. The drive drum 204 may be mounted on the frame by a number of well-known means. The drive drum 204 is driven by an electric motor 206 which powers a belt 208 through a drive pulley 210. A somewhat larger diameter driven pulley 212 is coupled to one end of drive drum 204 for rotation of the drive drum.

As will be appreciated, ideally the diameter of drive drum 204 (preferably from about 4 inches in diameter to 8 inches diameter) is much larger than the diameter of the drive roller 78 used in the embodiment of the present invention (FIGS. 1–5). This enables the belt 16 to be driven with less tension on the belt, thus reducing the tendency of the belt to "straighten in" between the drive drum 202 and the idler roller 200, and thereby conforming better to the curvature of the deck 56. Moreover, by locating the drive drum 204 at the rear of the treadmill 200, less "loading" is required between the belt 16 and the drive drum than if the drive drum were located at the front of the treadmill. The reason for this is because the belt 16 travels rearwardly (from the front end 58 to the rear end 60) along the deck 56, the drive drum 204 drives directly the section of the belt 16 that rides along deck 56, rather than driving the belt at the opposite end of the deck 56 after the belt has traveled back to the front of the deck in its lower return run around take-up pulley roller 88.

Figure 7:
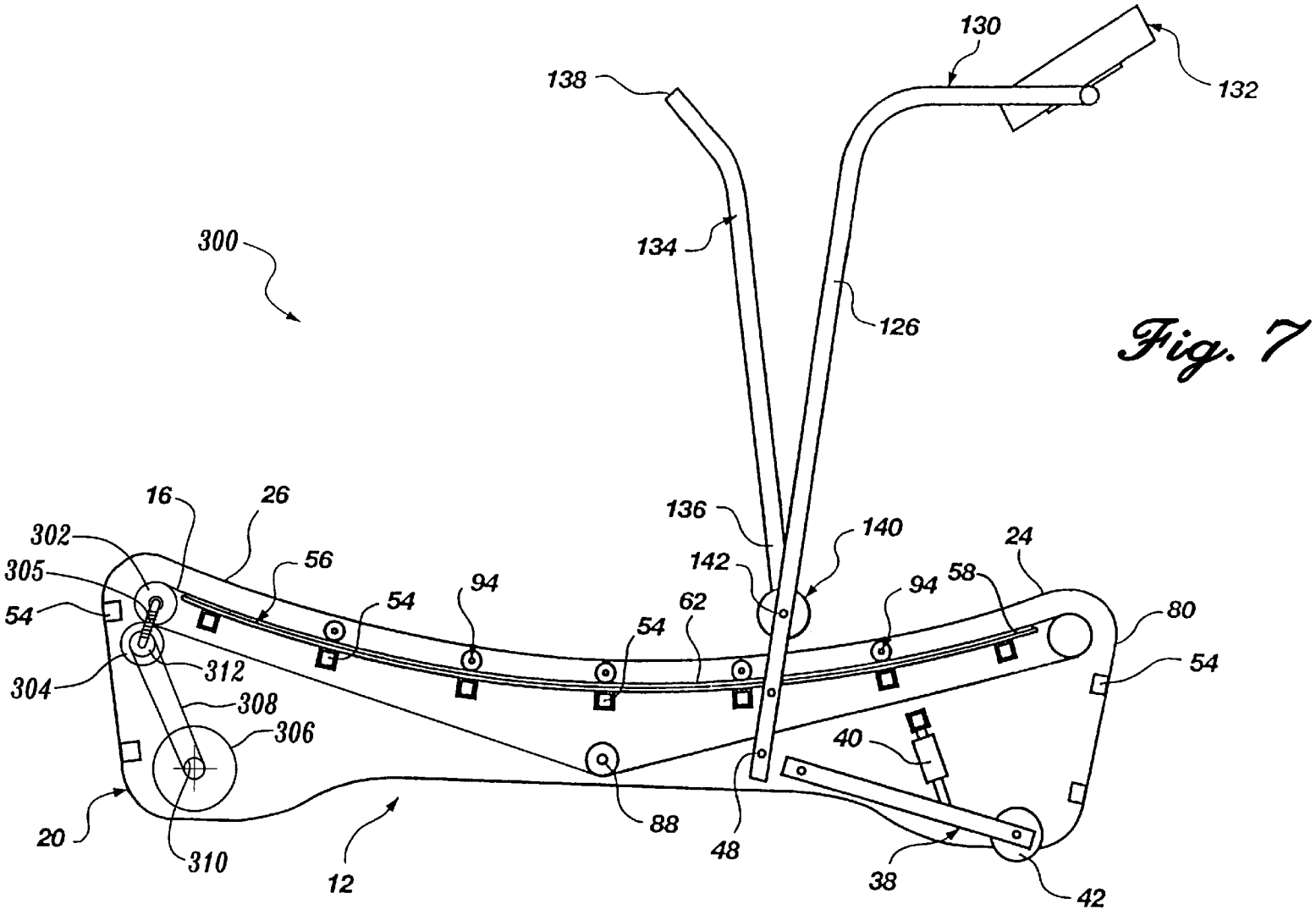
FIG. 7 is side elevational view similar to FIGS. 2 and 6 illustrating a further preferred embodiment of the present invention.

A further embodiment of the present invention is illustrated in FIG. 7 wherein the belt 16 of the treadmill 300 is also driven at the rearward end 60 of the deck 56. The rearward end of the belt 16 is received between upper and lower pinch rollers 302 and 304 that are rotatably mounted on the support frame 12 to extend between the first and second sides 20 and 22 of the support frame. As shown in FIG. 7, the lower pinch roller 304 is loaded upwardly against the upper pinch roller 302 by springs 305 to impart a compression load on the portion of the endless belt 16 extending therebetween. Also as illustrated in FIG. 7, the lower pinch roller 304 is driven by an electric motor 306 acting through a drive belt 308. The motor 306 powers a drive pulley 310 which in turn powers a driven pulley 312 through the belt 308. The driven pulley is ideally attached to one end portion of the lower pinch roller 304 in a well-known manner.

The drive system shown in FIG. 7 does have the advantage of being located contiguous the second end 60 at the deck 56 so as to "directly" drive the belt 16, as described above with respect to the embodiment of the present invention shown in FIG. 6. Moreover, the compression load between the pinch rollers 302 and 304 is used to "grip" the endless belt 16 rather than having to rely on the friction generated between a drive roller (pinch roller 302) and the belt 16 wrapped partially therearound. It is thus possible to power the belt 16 with less tension imparted to the belt, and in particular the portion of the belt riding over the top of deck 56. As such, the endless belt 16 better conforms to the curvature of the deck 56 than typically might be possible in the embodiment of the present invention shown in FIGS. 1–5.

Rather than being located at the rear end 60 of the deck 56, the pinch rollers could be positioned elsewhere relative to the deck. For example, the pinch rollers could be located beneath an intermediate portion of the deck, for instance at the location of third roller 88, in which case an idle roller such as roller 86, may be used at the near end 60 of the deck. Alternatively, the pinch rollers may be located at the front of the deck.

FIGS. 8–13 illustrate alternative preferred structures for retaining the belt 16 in a curvilinear configuration substantially flush with the upper surface 66 of the deck 56. In these figures, those components that are the same as, or similar to, corresponding components shown in FIGS. 1–7 are identified with the same part number.

Figure 8:
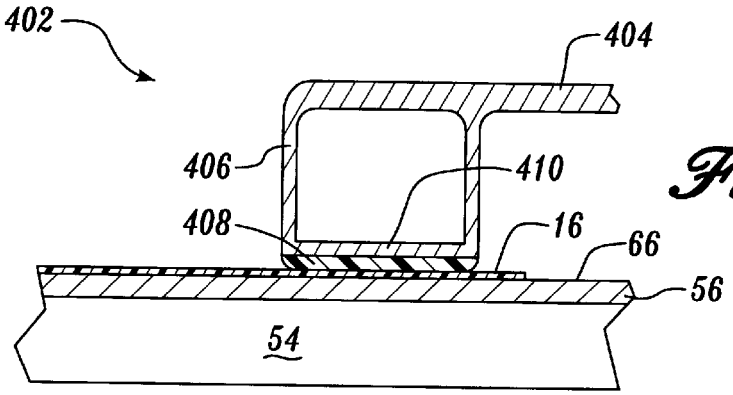
FIG. 8 is an enlarged fragmentary cross-sectional view similar to a portion of FIG. 5 illustrating another preferred embodiment of the present invention.

Referring initially to FIG. 8, a belt securing assembly 402 is integrated into the structure of cover member 404 which corresponds to cover member 168 shown in FIGS. 1 and 5. A tubular retaining member 406, of generally square or rectangular cross-section, is integrated into the construction of cover 404 so as to be located over the marginal edge portion of belt 16. Ideally, a low friction slide surface 408 is mounted on the underside of, or integrated into the construction of, the bottom wall 410 of the retaining member 406. Such low friction material might include, for example, Teflon™, graphite, polished stainless steel, material from which the deck 56 is constructed (phenolic impregnated wood), nylon or a form of plastic or other low friction, but durable material that is commercially available. The slide surface 408 is spaced just slightly above the top surface 66 of the deck 56 so as to receive the belt 16 closely between the upper surface 66 and the slide surface 408. In this manner, the endless belt 16 slides freely between the deck 56 and the retaining member 406 while closely assuming the longitudinal contour of the deck 56.

Figure 9A:
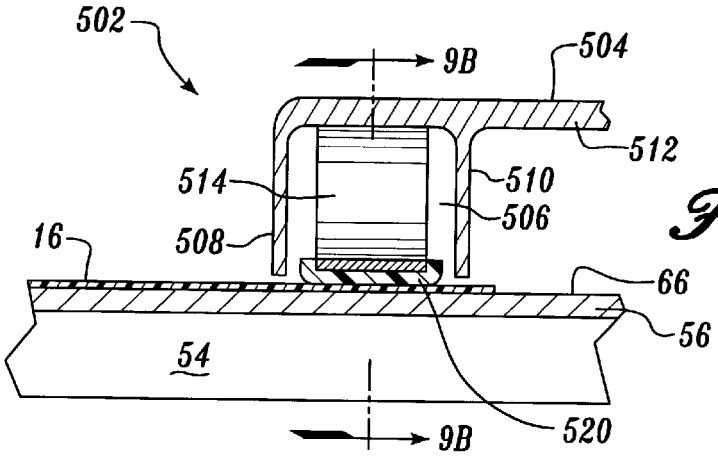
FIG. 9A is a view similar to FIG. 8 illustrating the further preferred embodiment of the present invention.
Figure 9B:
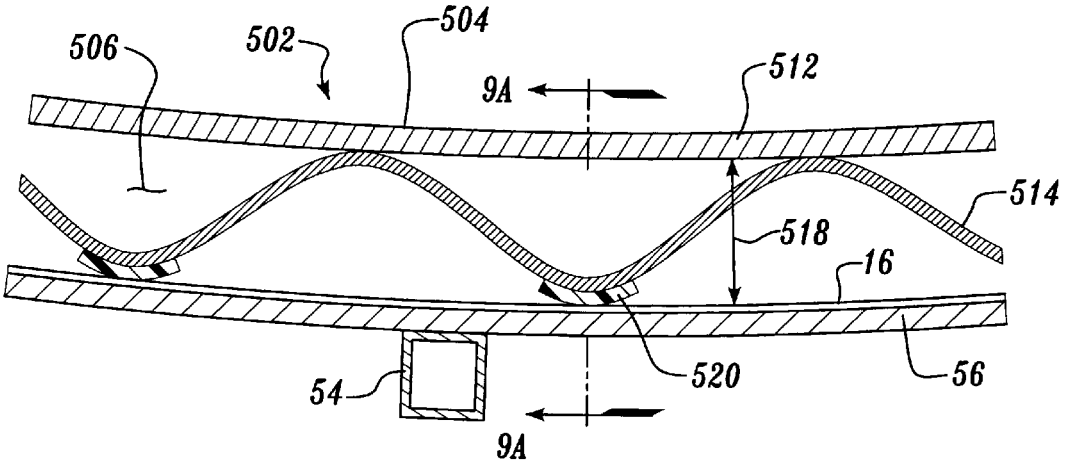
FIG. 9B is an enlarged fragmentary cross-sectional view of the preferred embodiment of the present invention shown in FIG. 9A taken substantially along lines 9B—9B thereof.

Next, referring to FIGS. 9A and 9B, a further belt securing assembly 502 is illustrated, which also is integrated into the construction of cover member 504, which cover member corresponds to cover members 404 and 168 described above. The belt securing assembly 502 includes a downwardly-extending channel 506 formed by vertical legs 508 and 510 extending downwardly from the top horizontal wall 512 of the cover member 504 in spaced parallel relationship to each other. The channel 506 is sized to closely receive a retaining member 514 therein, which retaining member is ideally formed in a generally sinusoidal shape, as shown in FIG. 9B. Preferably, the retaining member is constructed from a durable, resilient material, such as a spring steel or a durable plastic. Also ideally, the nominal amplitude of the wave form of the retaining member is slightly greater than the distance 518 between the underside of cover horizontal wall 512 (within the channel 506) and the top surface of the endless belt 16 so as to impose a downward load on the belt at the spaced-apart locations 520 that the retaining member 514 contacts the belt. Also, the surfaces of the contact locations of retaining member 514 may be coated with a low friction material so as to minimize sliding resistance between the contact locations 520 and the belt or a lubricant could be incorporated into the retaining member itself. Such low friction material might include Teflon™, graphite, polished stainless steel, deck material, nylon, a form of plastic or other lowfriction, but durable coating that is commercially available.

Figure 10A:
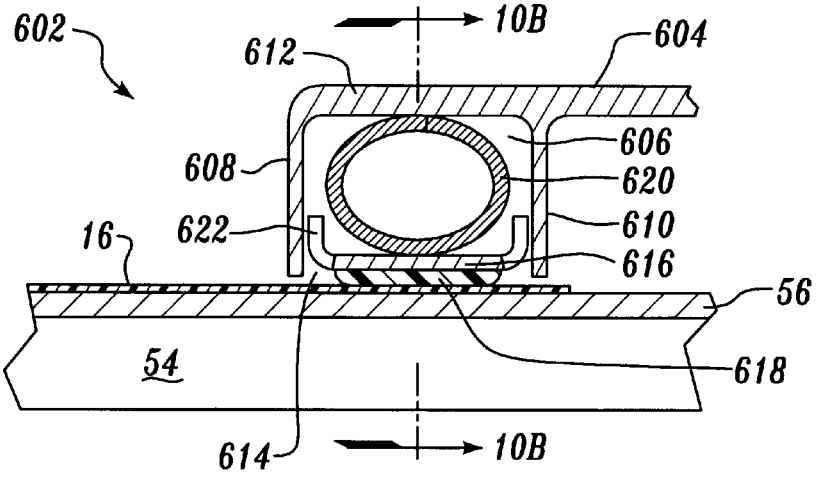
FIGS. 10A and 10B are views similar to FIGS. 9A and 9B illustrating an additional preferred embodiment of the present invention.
Figure 10B:
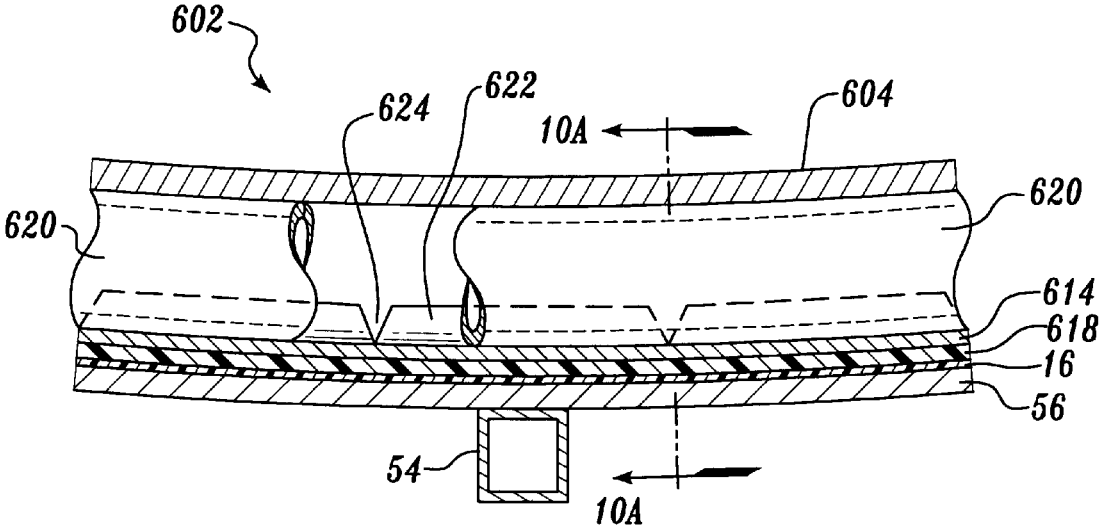

FIGS. 10A and 10B disclose a belt securing assembly 602 which is also incorporated into the construction of the cover member 604 in the manner of belt securing assemblies 94, 402 and 502, discussed above. Belt securing assembly 602 includes a downwardly-open channel 606 defined by walls 608 and 610 extending downwardly in laterally spaced apart relationship from cover top wall 612. A generally channel-shaped retaining member 614 is sized to slidably engage within channel 606. The retaining member 614 includes a lower or bottom wall 616, which ideally is substantially parallel to the longitudinally curved top surface 66 of deck 56. Ideally, the bottom wall 616 includes a low friction face 618 which bears against the upper surface of belt 16 through the urging of a tubular, elastomeric spring 620 extending along the retaining member 614 and held captive within channel 606. The elastomeric spring 620 can be composed of rubber, synthetic rubber, a plastic compound or other suitable material. As in the embodiments of the present invention discussed above, the low friction face 618 may be composed of suitable materials such as Teflon™, graphite, polished stainless steel, deck material, nylon, plastic and other commercially available materials. Also, the low friction face may be incorporated into the composition of the bottom wall 616 of a separate member or layer that is attached to the bottom wall.

As illustrated in FIGS. 10A and 10B, the sidewalls 622 of retaining member 614 are notched, such as at 624, to enable the retaining member to flex in an upwardly concave manner, thereby to closely assume the longitudinal curvature of the deck 56 while guiding the retaining member 614 for relative movement within channel 606 towards and away from the deck 56 with the flexure of the deck during use.

It is to be understood that other well-known means may be used to load the retaining member 614 downwardly against the belt 16 in lieu of spring 620 without departing from the spirit or scope of the present invention. Moreover, the sidewalls 622 of the retaining member 614 may be formed in other shapes or configurations and still allow the retaining member to be flexible enough to accommodate changes in curvature of the deck 56 during use.

Figure 11:
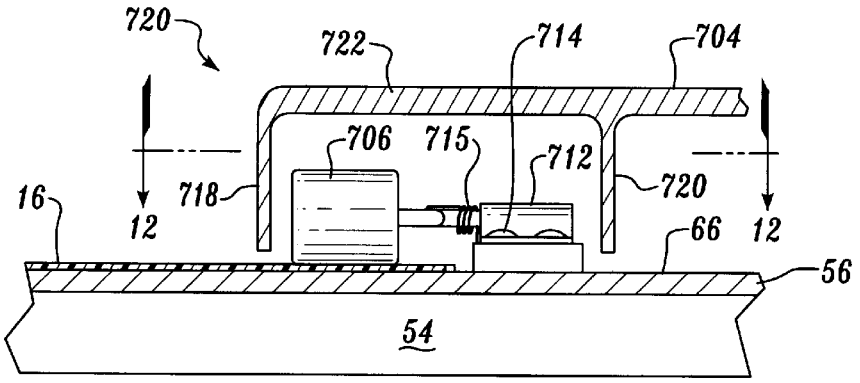
FIGS. 11 is a view similar to FIG. 9A illustrating another preferred embodiment of the present invention.
Figure 12:
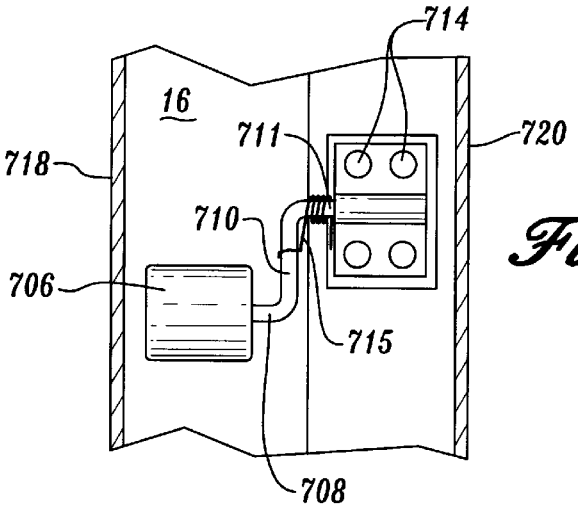
FIG. 12 is a top cross-sectional view of FIG. 11 taken substantially along lines 12—12 thereof; and, FIG. 13 is a view similar to FIG. 11 illustrating another preferred embodiment of the present invention.

FIGS. 11 and 12 illustrate a further belt securing assembly 702 which is mounted on the deck 56 rather than incorporated into the structure of cover member 704 in the manner of the belt securing assemblies 94, 402, 502 and 602. The belt securing assembly 702 includes a roller 706 rotatably mounted on a shaft 708 of a crank arm 710. The other end of the crank arm (defined by shaft 711) is pivotally mounted within a mounting block 712 secured to the side margin of deck 56 by hardware members 714 or other convenient means. A torsion spring 715 is interposed between mounting block 712 and the crank arm 710, thereby to load the roller 716 downwardly against the upper surface of endless belt 16. As shown in FIG. 11, the belt securing assembly 702 is located beneath the cover member 704 and between spaced-apart walls 718 and 720 which extend downwardly from the cover top wall 722 thereby to afford protection for a belt securing assembly 702.

A plurality of belt securing assemblies 702 may be located along the side margins of the deck 56, with the number and spacing of the belt securing assemblies selectable as required. An advantage of the belt securing assembly 702 is that changes in the longitudinal curvature of the deck 56 (for instance during use) are automatically compensated for by the belt securing assemblies. Moreover, the downward pressure imposed on the side margins of the endless belt 16 may be altered by changing the characteristics of spring 715.

Figure 13:
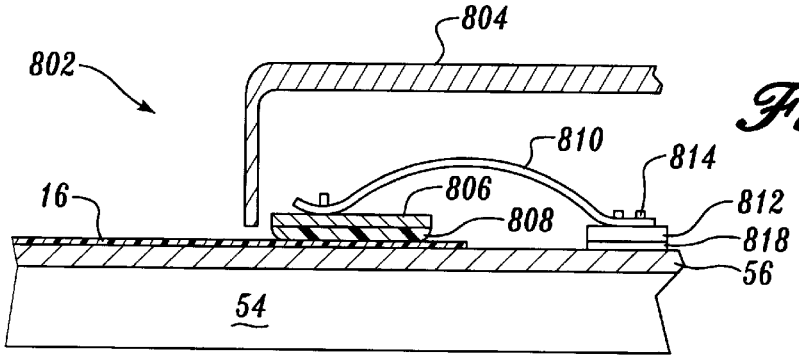

A further preferred embodiment of the present invention is shown in FIG. 13, which illustrates a belt securing assembly 802 also mounted along the side margins of deck 56 in a manner similar to the belt securing assembly 702. As with belt securing assembly 702, the belt securing assembly 802 is located beneath cover member 804, which cover member affords protection for the belt securing assembly. The belt securing assembly 802 includes a pressure pad 806, which ideally is generally rectangular or square in shape with the lower perimeter 808 radiused or beveled so as not to present sharp comers or edges to endless belt 16. A curved, resilient arm 810 extends from generally the top, center portion of the pressure pad 806 to a mounting lug or base 812 which is secured to the side margin of the deck 56 by appropriate fasteners 814, which may be screws, bolts or other types of hardware members. Ideally, the arm 810 is formed from a resilient, but high strength, material so as to cause the pressure pad 806 to impose a desired downward load on the side margins of endless belt 16. One or more shims 818 may be placed beneath base 812 so as to adjust the downward load imposed on pressure pad 806 by arm 810.

It will be appreciated that the pressure pad 806 may be formed in shapes other than square or rectangular, such as oval or round. Also a plurality of belt securing assemblies 802 may be positioned along the lengths of the side margins of deck 56 as required to satisfactorily retain the endless belt 16 in a curvilinear configuration corresponding to the curvature of the upper surface 66 of the deck 56.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An exercise treadmill, comprising:

a. a longitudinally extending support frame;

b. a longitudinally extending deck supported by the support frame, said deck being upwardly concave in the direction along the length of the support frame;

c. an endless belt positioned to slide over the top of the deck while being supported by the deck; and d. at least one belt retention assembly to retain the belt substantially flush with the deck.

2. An exercise treadmill as defined in claim 1, wherein the retention assembly is carried by the support frame.

3. An exercise treadmill as defined in claim 2, wherein the retention assembly comprises a plurality of rollers spaced apart from each other along the support frame, said rollers being positioned over the side margins of the endless belt.

4. An exercise treadmill as defined in claim 3, wherein the rollers are carried on support shafts cantilevered over the side margins of the belt.

5. An exercise treadmill as defined in claim 3, wherein the rollers are resiliently loaded against the belt.

6. An exercise treadmill as defined in claim 2, wherein the retention assembly extends longitudinally along the frame to present a slide surface to the top, side margins of the belt.

7. An exercise treadmill as defined in claim 6, wherein the slide surface comprises an antifriction composition.

8. An exercise treadmill as defined in claim 7, wherein the antifriction material is selected from the group consisting of Teflon™, graphite, nylon, plastic, stainless steel and phenolic impregnated wood.

9. An exercise treadmill as defined in claim 6, wherein the retention assembly loads the slide surface against the top margin of the belt.

10. An exercise treadmill as defined in claim 9, wherein the slide surface is spring loaded against the top margin of the belt.

11. An exercise treadmill as defined in claim 9, wherein the retention assembly resiliently loads the slide surface against the top margin of the belt.

12. An exercise treadmill as defined in claim 1, wherein the retention assembly is carried by the deck.

13. An exercise treadmill as defined in claim 12, wherein the retention assembly includes a plurality of rollers spaced apart along the side margins of the deck to position the rollers over the side margins of the belt.

14. An exercise treadmill as defined in claim 1, further comprising a cover structure extending along the side margins of the deck at an elevation above the deck, and the belt retention assembly is carried by the cover structure.

15. An exercise treadmill as defined in claim 14, wherein the retention assembly is located between the cover structure and the endless belt.

16. An exercise treadmill as defined in claim 14, wherein the retention assembly comprises a plurality of rollers spaced apart from each other along the cover structure and positioned over the side margins of the endless belt.

17. An exercise treadmill as defined in claim 1, further comprising a power drive system to move the endless belt over the deck.

18. An exercise treadmill as defined in claim 17:

a. wherein the support frame has a forward and rearward end portion; and b. wherein the drive system comprises a drive roller at one of the forward and rearward end portions of the support frame, the endless belt being trained over the drive roller, and a power supply to rotate the drive roller and thereby move the belt over the deck.

19. An exercise treadmill as defined in claim 17, wherein the power drive system comprising:

a pair of rollers disposed transversely to the length of the endless belt and positioned in close, spaced parallel relationship to each other to receive the endless belt between the roller pair whereupon the roller pair applies a compression load to the belt; and a power supply to drive one or both of the rollers to move the belt as the pair of rollers rotate.

20. An exercise treadmill as defined in claim 19, wherein the support frame has a forward end portion and a rearward end portion, the pair of rollers located adjacent either the forward or rearward end portion of the support frame, with the endless belt trained over one of the rollers of the pair of rollers.

21. An exercise treadmill, comprising:

a longitudinal frame assembly;

a deck supported by the frame assembly, the deck comprising a first end portion, a second end portion and an intermediate portion, the deck intermediate portion having a substantially arcuate longitudinal configuration curving downwardly between the first and second end portions of the deck to an elevation substantially below the first and second end portions of the deck;

an endless belt having an upper run sliding over and supported by the deck to present a moving, upwardly concave surface; and a belt retaining system for retaining the endless belt substantially flush with the deck.

22. An exercise treadmill as defined in claim 21, wherein the retention system is carried by the frame assembly.

23. An exercise treadmill as defined in claim 22, wherein the retention system comprises a plurality of rollers spaced apart from each other along the frame, the rollers being positioned over the side margins of the endless belt.

24. An exercise treadmill as defined in claim 23, wherein the rollers are carried on support shafts cantilevered over the side margins of the endless belt.

25. An exercise treadmill as defined in claim 23, wherein the rollers are resiliently loaded against the endless belt.

26. An exercise treadmill as defined in claim 22, wherein the retention system extends longitudinally along the frame to present a slide surface to the top, side margins of the endless belt.

27. An exercise treadmill as defined in claim 26, wherein the slide surface comprises an low friction composition.

28. An exercise treadmill as defined in claim 27, wherein the low friction material is selected from the group consisting of Teflon™, graphite, stainless steel, phenolic impregnated wood, nylon and plastic.

29. An exercise treadmill as defined in claim 26, wherein the retention system loads the slide surface against the top margin of the endless belt.

30. An exercise treadmill as defined in claim 21, wherein the retention system is carried by the deck.

31. An exercise treadmill as defined in claim 30, wherein the retention system includes a plurality of rollers spaced apart along the side margins of the deck to position the rollers over the side margins of the endless belt.

32. An exercise treadmill as defined in claim 21, further comprising a cover structure extending along the side margins of the deck at an elevation above the deck, and the belt retention system is carried by the cover structure.

33. An exercise treadmill as defined in claim 32, wherein the belt retention system is located between the cover structure and the endless belt.

34. An exercise treadmill according to claim 32, wherein the retention assembly comprises a plurality of rollers spaced apart from each other along the cover structure and positioned over the side margins of the endless belt.

35. An exercise treadmill according to claim 21, further comprising a power drive system to move the endless belt over the deck.

36. An exercise treadmill as defined in claim 35:

a. wherein the frame assembly has a forward end portion and rearward end portion; and b. wherein the drive system comprises a drive roller at one of the forward and rearward end portions of the frame assembly, the endless belt being trained over the drive roller, and a power supply to rotate the drive roller and thereby move the endless belt over the curved deck.

37. An exercise treadmill according to claim 35, wherein the power drive system comprising:

a pair of rollers disposed transversely to the length of the endless belt and positioned in close, spaced parallel relationship to each other to receive the endless belt between the roller pair whereupon the roller pair applies a compression load to the belt; and a power supply to drive one or both of the rollers to move the belt as the pair of rollers rotate.

38. An exercise treadmill according to claim 37, wherein the frame assembly has a forward end portion and a rearward end portion, the pair of rollers located adjacent either the forward or rearward end portion of the frame assembly, with the endless belt trained over one of the rollers of the pair of rollers.

* * * * *

UNITED STATES PATENT AND TRADEMARK OFFICE

CERTIFICATE OF CORRECTION

PATENT NO. : 5,897,461

DATED : April 27, 1999

INVENTOR(S) : J.D. Socwell

It is certified that error appears in the above-identified patent and that said Letters Patent is hereby corrected as shown below:

| COLUMN | LINE | |
|---|---|---|
| [56] Pg. 1, col. 2 | Refs. Cited (Other Publs.) | Before "Copy of . . ." delete "Document Information" |
| [56] Pg. 1, col. 2 | Refs. Cited (Other Publs.) | After "3,642,279" and before "." delete "(U10-above)" |
| 4 | 66 | "FIGS. 11" should read --FIG. 11-- |
| 12 | 2-3 | "ther-ebetween" should read --therebetween-- |
| 12 | 56-57 | "ther-ebetween." should read --therebetween.-- |
| 15 | 51 | "lowfriction," should read --low-friction,-- |
| 16 | 63 | "comers" should read --corners-- |

UNITED STATES PATENT AND TRADEMARK OFFICE

CERTIFICATE OF CORRECTION

PATENT NO. : 5,897,461

DATED : April 27, 1999

INVENTOR(S) : J.D. Socwell

It is certified that error appears in the above-identified patent and that said Letters Patent is hereby corrected as shown below:

| COLUMN | LINE | |
|---|---|---|
| 19 (Claim 27, line 2) | 8 | "an low" should read --a low-- |

Signed and Sealed this

Fifth Day of October, 1999

*Attest:*

*Attesting Officer*

Q. TODD DICKINSON

*Acting Commissioner of Patents and Trademarks*